United States Patent [19]

Easler

[11] 4,226,154

[45] Oct. 7, 1980

[54] ELECTRONIC MUSICAL INSTRUMENT

[76] Inventor: Dean E. Easler, 193 Pennsylvania Ave., Medford, N.Y. 11763

[21] Appl. No.: 965,812

[22] Filed: Dec. 4, 1978

[51] Int. Cl.[3] ..... G10H 1/36; G10H 1/40

[52] U.S. Cl. ..... 84/1.01; 84/1.03; 84/1.17; 84/DIG. 12; 84/DIG. 22

[58] Field of Search ..... 84/1.01, 1.03, 1.17, 84/1.24, DIG. 7, DIG. 8, DIG. 12, DIG. 19, DIG. 22, 470 R

[56] References Cited

U.S. PATENT DOCUMENTS

| | | | |
|---|---|---|---|
| 3,247,307 | 4/1966 | Campbell, Jr. | 84/1.03 |
| 3,342,094 | 9/1967 | Wilson | 84/DIG. 25 |
| 3,478,159 | 11/1969 | Olson | 84/1.17 |
| 3,519,722 | 7/1970 | Heytow | 84/1.17 |
| 3,555,166 | 1/1971 | Gasser | 84/1.01 |
| 3,585,893 | 6/1971 | Arseneault | 84/1.17 |
| 3,704,339 | 11/1972 | Niinomi | 84/1.24 |
| 3,705,948 | 12/1972 | Tomisawa | 84/1.24 |
| 3,750,516 | 8/1973 | Olson | 84/470 R |
| 3,823,245 | 7/1974 | Suzuki | 84/1.24 X |
| 3,962,945 | 6/1976 | Creager et al. | 84/1.01 |
| 4,022,097 | 5/1977 | Strangio | 84/1.03 |
| 4,078,464 | 3/1978 | Sugiyama | 84/1.01 |
| 4,126,070 | 11/1978 | Hill | 84/1.01 |

*Primary Examiner*—Stanley J. Witkowski

*Attorney, Agent, or Firm*—A. C. Nolte, Jr.; Edward B. Hunter

[57] ABSTRACT

An electronic musical keyboard instrument has a unit separate from the main console and having switching means for performing the function of at least some of the keys and stops of the console that unit being adapted to be operated by a handicapped person.

21 Claims, 4 Drawing Figures

ELECTRONIC MUSICAL INSTRUMENT

BACKGROUND OF THE INVENTION

The invention is concerned with an electronical musical keyboard instrument and particularly is concerned with such instruments for use by handicapped people whose handicaps would prevent them from using a conventional instrument or using such an instrument to its full capacity.

A conventional electronic musical instrument comprises a console with one or more keyboards, a series of pedals, a series of stops which permit the pre-programmed production of tones in a repetitive sequence to simulate a desired rhythm and a series of stops which modify the sound produced by the instrument to resemble those of different instruments as, for example, woodwinds, brass, strings and piano. Pedals normally provide at least an octave of bass notes and a sound (expression) intensity control. Many instruments are provided with other controls to allow the reproduction of more complex effects. It will, of course, be appreciated that other configurations than that discussed here above may be used.

The console also includes electronic sound producing equipment such as oscillators, amplifiers, logic units, etc. and, if desired, certain portions such as the amplifiers and speakers may be housed in separate cabinet structures.

It will be appreciated that to play an instrument of this kind a rather high degree of physical dexterity and coordination is required since the player generally must use both hands and feet. However, in view of the great range and flexibility of the instrument it is a most desirable one, particularly for solo players or players in small groups; or most importantly, persons desiring to study and reproduce a full musical ensemble (solo or melody, accompaniment and bass).

To date most physically handicapped people have not been able to experience the pleasure of this instrument and it is an object of the present invention to afford them that pleasure.

BRIEF SUMMARY OF THE INVENTION

To permit a physically handicapped person to play an electronical musical instrument a portion of the controls which would normally be an integral part of the console and which would be difficult or impossible for a handicapped person to operate are either redesigned to be operable by a handicapped person or are mounted upon a separate control unit which may be disposed in such a position as to be operable by the handicapped person.

The portion which is modified may be a duplicate of the corresponding controls on the console or it may be a replacement for those original controls. In the first instance, it will be recognized that the instrument may be played in the normal manner by a non-handicapped person. In either instance a unit containing the modified portion may be connected by an appropriate umbilicus to the electronic equipment within the main console.

It is also to be recognized that there may be a plurality of such modified units any number or all of which may be connected to the main console to permit the operation of the instrument by people having different handicaps, or even in certain instances, to permit the instrument to be operated by several people.

The modified portion or unit may be designed either to be free-standing or be borne by the person operating that unit. Further, it may be modified to accommodate operation by a limb or digits of the handicapped person or, if the handicap is such that would preclude this, it is possible that the controls of that unit may be pneumatically operated so as to be controllable by blowing into selected switching elements.

DESCRIPTIONS OF THE FIGURES OF THE DRAWINGS

An embodiment of the invention is illustrated in the accompanying drawings which:

DESCRIPTION OF THE PREFERRED EMBODIMENTS

Figure 1:
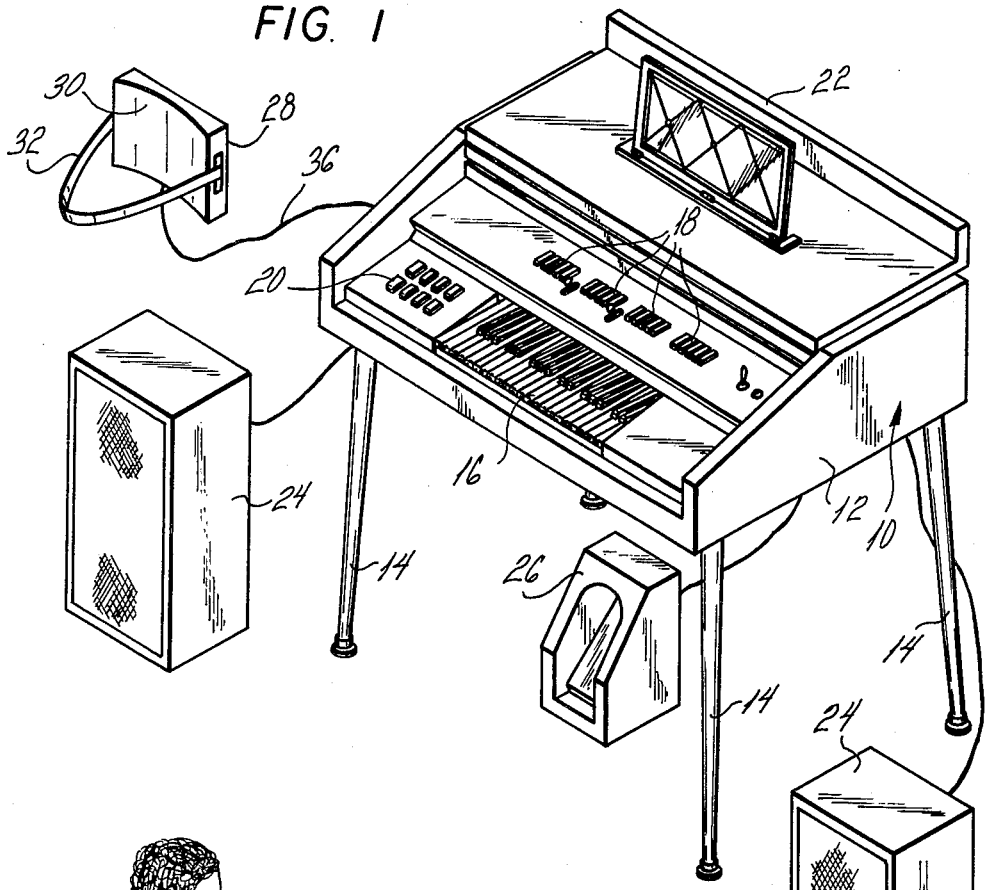
FIG. 1 is a perspective view of a simple embodiment of the invention.

The instrument in FIG. 1 comprises a main console 10 which has the usual electronic equipment associated with such instruments contained within cabinet structure 12 and which has additional wiring as described hereinafter. The cabinet structure is supported upon legs 14.

The console has a conventional keyboard as at 16 and a plurality of banks of stops as at 18. Additionally, selector stops as at 20 are provided. The stops 18 may be operated to call for different musical characteristics to be produced by the instrument as, for example, it may call for the instrument to produce a reed sound or a piano sound or the sounds of other instruments. The selector stops 20 may be operated to select a particular rhythm to be produced by the instrument. A lid is provided at 22 for closing the console.

Speakers 24 are provided for disposition at desired locations and are connected to the main console as is a sound intensity control pedal 26.

Figure 3:
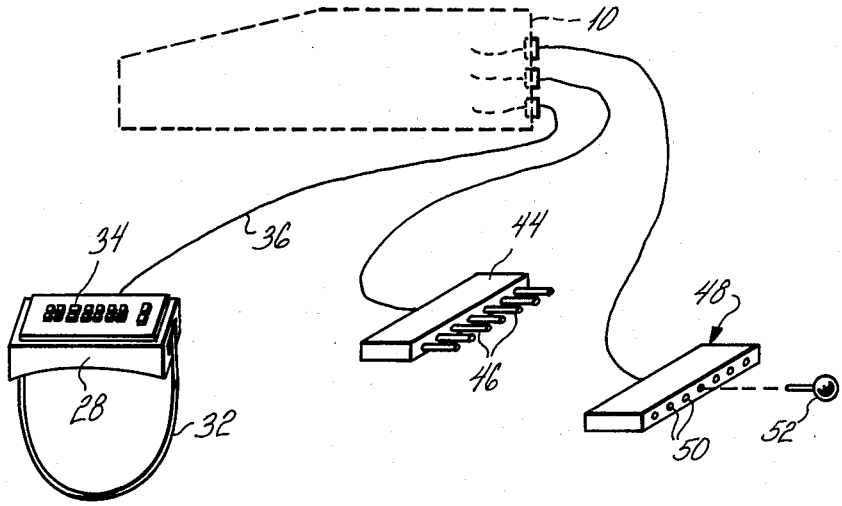
FIG. 3 is a schematic view of an alternative embodiment of the invention.

A modified unit 28 is provided which in this instance is specially adapted to be carried on the body of a person playing the instrument. Specifically, it has a generally concave surface as at 30 to conform to the torso of a player and a shoulder strap as at 32 by which it may be suspended in position. The unit 28 comprises, as can be seen in FIG. 3, a plurality of control switches 34 which may duplicate the functions of either of the sets of stops 18 and 20 or parts of the keyboard 16 or, in an instrument having two or more keyboards, the unit may duplicate the functions of parts of different ones of those keyboards. Unit 28 is connected, as described hereinafter, by an umbilicus 36 to the main console.

Figure 2:
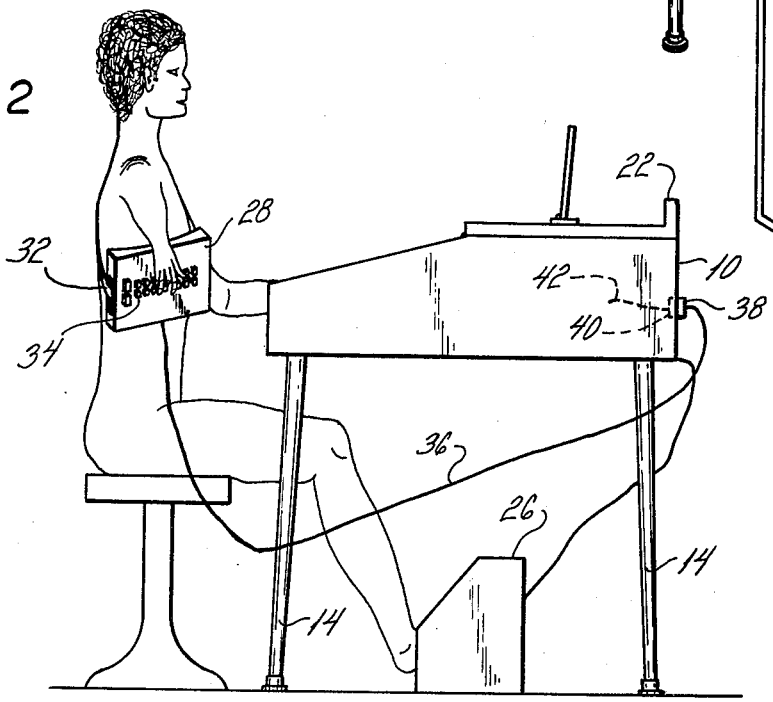
FIG. 2 is a side view illustrating the manner in which the invention might be used.

FIG. 2 shows how a person handicapped by having a right arm very much shorter than his left, may play the instrument illustrated in FIG. 1. In that figure, the unit 28 is supported against the chest of the player and is held in that position by the shoulder strap 32. As illustrated schematically in FIG. 2 the umbilicus 36 terminates in a plug and socket element 38 which is engaged in a complementary fixture 40 secured in the cabinet structure 12. Leading to the complementary element 40 is electrical wiring 42 which parallels the wiring leading from the various electrical components of the unit to the normal controls at 16, 18 and 20 of the console. it will be appreciated that a plurality of sets of wiring in 42, complete with their individual connecting elements 40, may be provided so that differently designed units 28 may be connected, in this way to accommodate the use of the device by people having different handicaps.

In FIG. 3 of the drawing there is illustrated, very schematically, a typical arrangement in which there are plural connecting elements, one of which is shown secured to a unit such as that 28 and the other of which is connected to a unit 44 which has air operable switching means and nozzles as at 46 by which a person, by blowing, may operate the instrument. An additional unit 48 is provided which has a plurality of photocell elements indicated at 50 onto a selected one of which a narrow beam of light may be directed by a flash-light type unit 52. Unit 52 may be designed, if need be, to be held in a users mouth.

Figure 4:
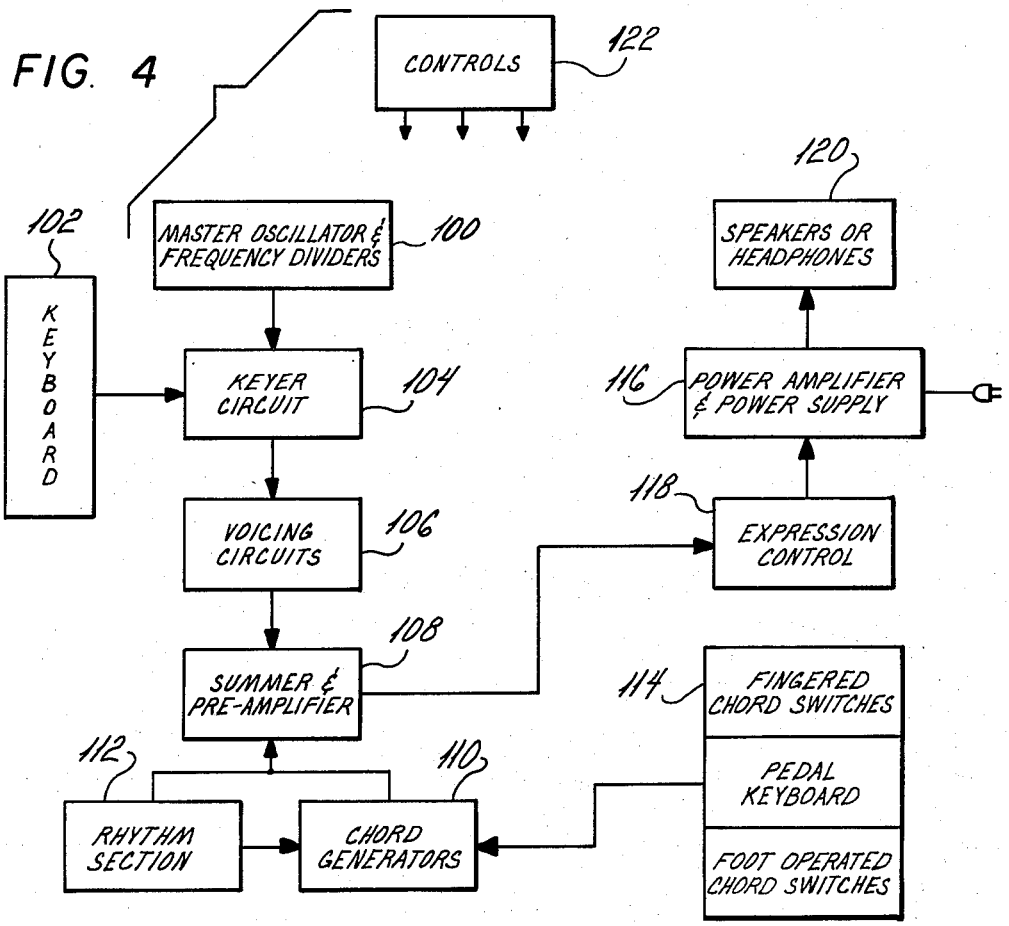
FIG. 4 is a schematic illustration of the various elements of an instrument according to this invention.

The components of the organ are illustrated schematically in FIG. 4 and comprise a unit 100 which includes the master oscillator and frequency dividers. The output of unit 100 is modified by keyboard means 102 controlling keyer circuit unit 104 and voicing circuit unit 106, and is applied to a summer and preamplifier at 108.

The output of chord generator unit 110 is also applied to the summer and is modified by a rhythm section unit 112 under the influence of various control units 114. the rhythm section unit 112 is also connected to the summer and preamplifier 108 for providing rhythm section inputs thereto.

The preamplifier is connected through an expression control 118 to the final amplifier section contained in unit 116 which also constitutes the power supply connection. The final amplifier section drives speakers or headphones at 120.

Control means, appropriately designed for operation by a handicapped person are provided at 122 and may duplicate the roles of all or part of the keyboard 102 or the controls at 114.

What is claimed is:

1. An electronic musical keyboard instrument comprising a console including sound producing and modulating circuitry and operator actuated first switching means formed of a number of switches for controlling said circuitry and initiating production and modification of sounds, and a separate unit including a second switching means formed of a number of switches less than the number of switches of said first switching means for functionally duplicating only a portion of said first switching means for controlling said circuitry, said unit being specially adapted for operation by a physically handicapped person and being specially formed complementarily to the handicap of such person.

2. An instrument as claimed in claim 1 wherein said number of switches in said first switching means is divided into plural sets of switches each of said sets being connected to said circuitry to control a different function of said circuitry and wherein said second switching means of said unit duplicates the function of at least one of said sets of said first switching means of said console.

3. An instrument as claimed in claim 2 wherein said unit includes electrical umbilicus, and means for releasably connecting said umbilicus to said console.

4. An instrument as claimed in claim 2 wherein at least two said units are provided, each one of which duplicates a function of a different one of said sets of said first switching means of said console.

5. An instrument as claimed in claim 4 wherein each unit is provided with means by which it is releasably connected to said console.

6. An instrument as claimed in claim 1 wherein said unit comprises means by which it can be carried on the body of a user.

7. An instrument as claimed in claim 2 wherein said unit comprises means by which it can be carried on the body of a user.

8. An instrument as claimed in claim 1, wherein said second switching means comprise means for pneumatically actuating the same by the respiration of the operator.

9. An instrument as claimed in claim 2 wherein said second switching means comprise means for pneumatically actuating the same by the respiration of the operator.

10. An instrument as claimed in claim 4 wherein the second switching means of at least one of said units comprise means for pneumatically actuating the same by the respiration of the operator.

11. An instrument as claimed in claim 1 wherein said switching means comprise means for photo-electronically actuating the same by the operator.

12. An instrument as claimed in claim 2 wherein said second switching means comprise means for photo-electronically actuating the same by the operator.

13. An instrument as claimed in claim 4 wherein said second switching means comprise means for photo-electronically actuating the same by the operator.

14. An instrument as claimed in claim 8 wherein said second switching means further comprises means for photo-electronically actuating the same.

15. An electronic musical keyboard instrument comprising a console including sound producing and modulating circuitry, a keyboard capability, a series of rhythm stops operable to actuate a selected one of a plurality of components of said circuitry for producing a rhythmic effect, and a series of instrument stops operable to actuate a selected one of a plurality of components of said circuitry simulating the sound of a musical instrument, a unit comprising switching means for functionally duplicating only a portion of said keyboard capability, said series of rhythm stops and said series of instrument stops, said unit being specially adapted for operation by a handicapped person and being formed complementarily to the handicap of such person.

16. An instrument as claimed in claim 15 comprising electrical umbilicus means for releasably connecting said unit to said console.

17. An instrument as claimed in claim 15 wherein said switching means performs a function of a part of said keyboard and series of stops normally operated by a single limb.

18. An instrument as claimed in claim 15 comprising at least two said units, one or both of said units being releasably connectable to said console.

19. An instrument as claimed in claim 15 wherein said second switching means of said unit comprises means for pneumatically actuating the same by the respiration of the operator.

20. An instrument as claimed in claim 15 wherein said second switching means of said unit comprises means for photo-electronically actuating the same by the operator.

21. An electronic musical keyboard instrument of the type for providing sounds corresponding to a full musical ensemble, comprising:

a console including sound producing and modulating circuitry and first switching means for controlling said circuitry; and a separate unit having second switching means for controlling said circuitry, said separate unit being shaped and said second switching means being arranged for operation by a person who is physically disabled by having the functioning of at least one limb impaired and constituting means specifically formed complementarily to the person's impairment for operating said second switching means.

* * * * *